United States Patent [19]

Arndt et al.

[11] Patent Number: 5,076,548

[45] Date of Patent: Dec. 31, 1991

[54] COMMUTATION MEANS FOR ON-LINE ALLOYING

[75] Inventors: Eric D. Arndt, Lower Burrell; John M. Urbanic, Pittsburgh; Cecilio R. Sammy, Murrysville; Charles E. Eckert, Plum Boro; Clark W. Keller; William D. Tackett, both of Leechburg, all of Pa.

[73] Assignee: Aluminum Company of America, Pittsburgh, Pa.

[21] Appl. No.: 525,985

[22] Filed: May 21, 1990

[51] Int. Cl.[5] ..... C21B 13/00

[52] U.S. Cl. ..... 266/44; 266/216

[58] Field of Search ..... 266/44, 78, 104, 216

[56] References Cited

U.S. PATENT DOCUMENTS

| | | | |
|---|---|---|---|
| 3,729,309 | 4/1973 | Kawawa | 266/216 |
| 3,836,360 | 9/1974 | Bray | 75/135 |
| 4,512,800 | 4/1985 | Wirth, Jr. | 266/216 |
| 4,688,771 | 8/1987 | Eckert et al. | 266/78 |

FOREIGN PATENT DOCUMENTS

| | | | |
|---|---|---|---|
| 1217887 | 3/1986 | U.S.S.R. | 266/216 |

*Primary Examiner*—S. Kastler

*Attorney, Agent, or Firm*—Elroy Strickland

[57] ABSTRACT

Apparatus for commutating an electrical current to an electrically conductive rod of an alloying element during the feed thereof to a body of molten metal for purposes of changing the alloy composition of the metal. The apparatus includes a power supply capable of providing electrical current in amounts sufficient to melt a free end of the rod of alloying material into the molten metal, and a pair of parallel adjacent shafts of substantial cross-section. A pair of commutation wheels are mounted respectfully on said shafts for rotatably engaging the rod between the wheels and for conducting current to the rod. Means are provided for forcing the wheels against the rod to provide intimate electrical and physical contact between the rod and wheels. A plurality of stationary brushes are disposed to physically engage each of said shafts along the length thereof for supplying current to the shafts from the power supply, and from the shafts to the wheels engaging the rod.

8 Claims, 3 Drawing Sheets

COMMUTATION MEANS FOR ON-LINE ALLOYING

BACKGROUND OF THE INVENTION

Figure 1:
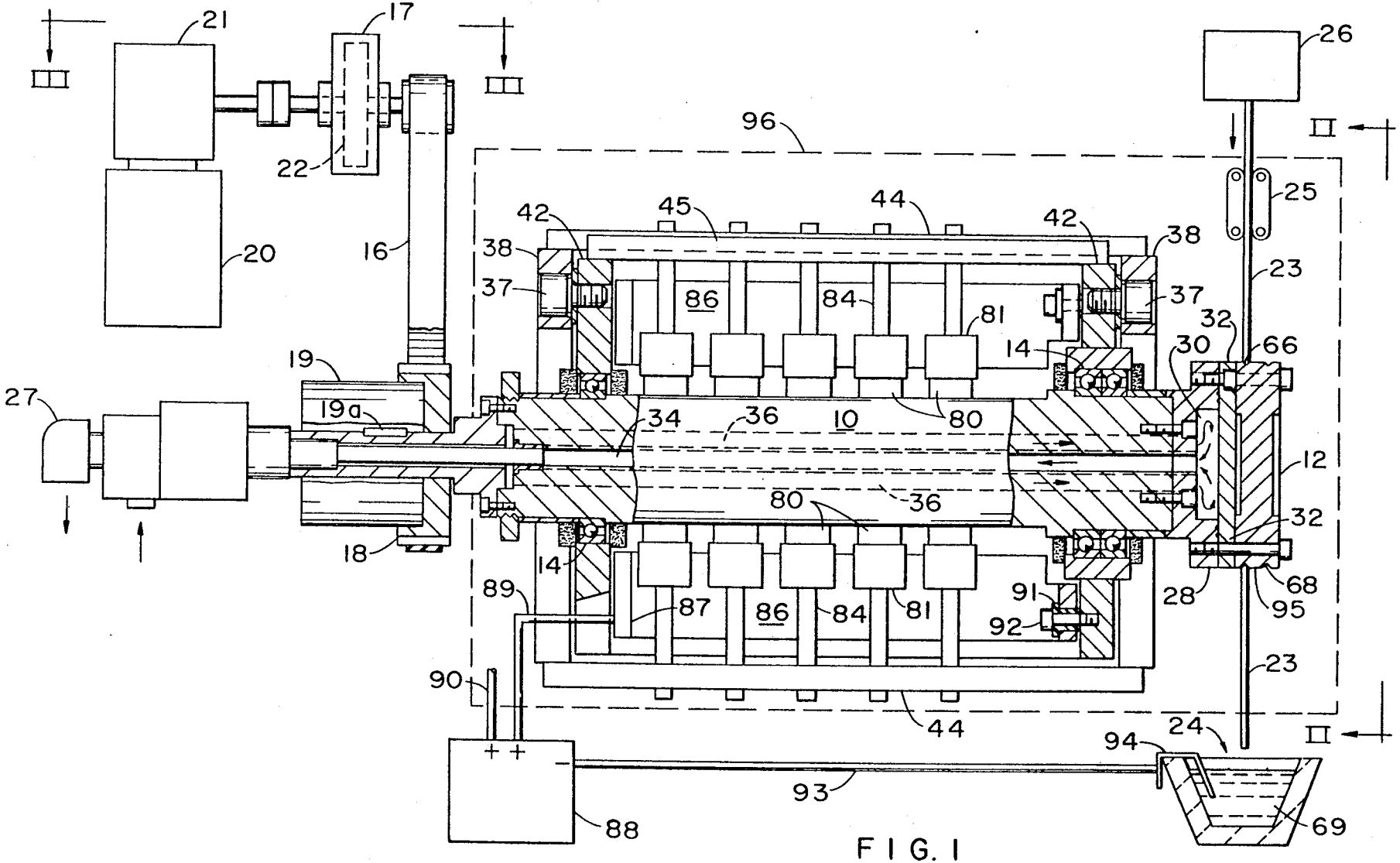

The present invention relates generally to commutation of large amounts of electrical current and particularly to commutating current to superheat a moving rod or bar of element material employed in alloying a molten metal media, such as molten aluminum, though the invention is not limited thereto.

In U.S. Pat. No. 4,688,771 to Eckert et al, an alloying material in the form of a wire 10 is shown directed to a molten media 12. (This patent is one of several U.S. patents to Eckert et al on alloying. To list all of the patents which here would be unduly repetitive.) Between the end of the wire adjacent the molten media and the media itself is a difference of a potential created by a power supply 36. This difference in potential causes a spark or arc to be formed between the wire and the molten media for the purpose of adding the alloying element or elements of the wire to the media in a manner that greatly enhances the alloying process. Such a process requires a substantial amount of electrical current to superheat the wire, and this current must be "commutated" to the wire from the electrical supply with minimal resistance to the flow of the current.

Heretofore, such current was usually commutated through stationary contact tubes, such as shown in the Eckert et al patent or through stationary "shoes", such as shown at 44 in U.S. Pat. No. 3,836,360 to Bray. Bray suggests using feed rollers to apply current to a master alloy feed wire in place of contact member 44 but prefers the non-rotating member for the reasons stated in the patent.

A common application of current transferring shoes is in the welding industry where a wire or rod of filler material, usually on the order of one-eighth inch diameter, is directed to a welding area. The rod functions as one electrode for developing a welding arc between it and the material to be welded. Such applications of current are generally (1) intermittent in nature, (2) require high quality electrode (wire) material, and require frequent changing of the stationary tubes or shoes because of the wear caused by friction occurring between the welding wire and shoes, and because the shoes collect wire material as the wire passes therethrough. Relative speed between a welding wire or rod and contact shoes is generally low, less than 2,000 inches per minute, with relatively low current requirements, using less than 1,000 amperes, and with current densities on the order of 200,000 amps per square inch.

A system being tested by Applicants for on-line alloying purposes, using one-quarter inch diameter lead bismuth rod requires current of 500 to 600 amps and a maximum speed of 960 inches per minute for periods of about one hour. In such a system, sliding (stationary) shoe commutators are adequate. However, when conditions are altered to use a one quarter inch diameter magnesium rod with current demands of 3,000 to 7,000 amps at speeds of 2200 inches per minute and current densities in excess of one million amps per square inch for extended periods of time, sliding shoes are not adequate and have led to the development and invention described below.

A sliding shoe requires high quality rod material in order to successively commutate an adequate amount of electrical current to the rod. A high quality rod is one in which there are minimum or no surface defects, such as checks, nicks or slices, or other types of scratches or flaws in the rod surface. Worn drawing dies, for example, leave "draw lines" that extend lengthwise of a rod.

Another element of quality is the cleanliness of the rod. Insulating substances, such as lubricants and oxides collect on the surfaces of the shoes and rod thereby interfering with current flow. In other words, both the surface of the shoe and the surface of the rod should be as smooth and clean as possible in order to adequately transfer electrical current.

SUMMARY OF THE INVENTION

The present invention is directed to roller or wheel commutator devices capable of transferring (commutating) substantial amounts of current to a wire, rod or bar at high speeds and at high current densities for substantially unlimited periods of time. The effectiveness of the current transfer is such that the quality of the surface of the wire, rod or bar can be low, as discussed hereinafter.

In the present invention, two opposed wheels, provided with the grooved surfaces for seating the rod or bar, and made of materials particularly suited for the purposes of invention, are pressed against the rod or bar and rotated in such a manner that there is little or no sliding movement between the rod and grooved surfaces (i.e., the rotational velocity of the wheels and lineal velocity of the rod are the same). This reduces substantially the tendency of rod material to collect on the wheels, i.e., the wheels, in effect, present a "new" surface to the rod with each increment of wheel rotation.

Further, the force of the wheels against the rod deforms the rod slightly to ensure a maximum surface area for transfer of current, and maximum use of the mass of the rollers and rod can be effected by using DC current, i.e., AC current, because of the "skin effect", tends to travel along peripheral surfaces of the wheels and rod. Such surface travel offers substantial resistance to the flow of current.

In addition, the force at which the wheels engage the rod is important from the standpoint of the occurrence of high current transients. If the lower, free end of an alloy rod momentarily contacts the molten metal in an alloying process, the surface of the molten metal being somewhat turbulent, a short circuit is created across the power supply. This results in a massive amount of current flow, since the resistance of the arc or plasma is eliminated and the only resistance offered to the flow of current is the resistance of the components conducting the flow, namely, the brushes, shafts, wheels and the rod itself. Such current transients, and any resulting arcing between the rod and wheels, will pit the surfaces of the wheels. By maintaining a high constant force between the surfaces of the wheels and rod, a low resistance path for current flow is assured and little or no arcing occurs between the wheels and rod, even with high current transients.

Electrical current is supplied to the rollers respectively through two relatively large diameter rotatable shafts which, in turn, receive current from a large plurality of stationary brushes disposed in rotating contact with the shafts. The brushes extend half way around the periphery of each shaft, and could completely surround the shaft except for presence and interference of the other shaft, so that large amounts of current can be supplied to the shafts and wheels, and thus to the rod or bar being propagated between the wheels.

THE DRAWINGS

Figure 2:
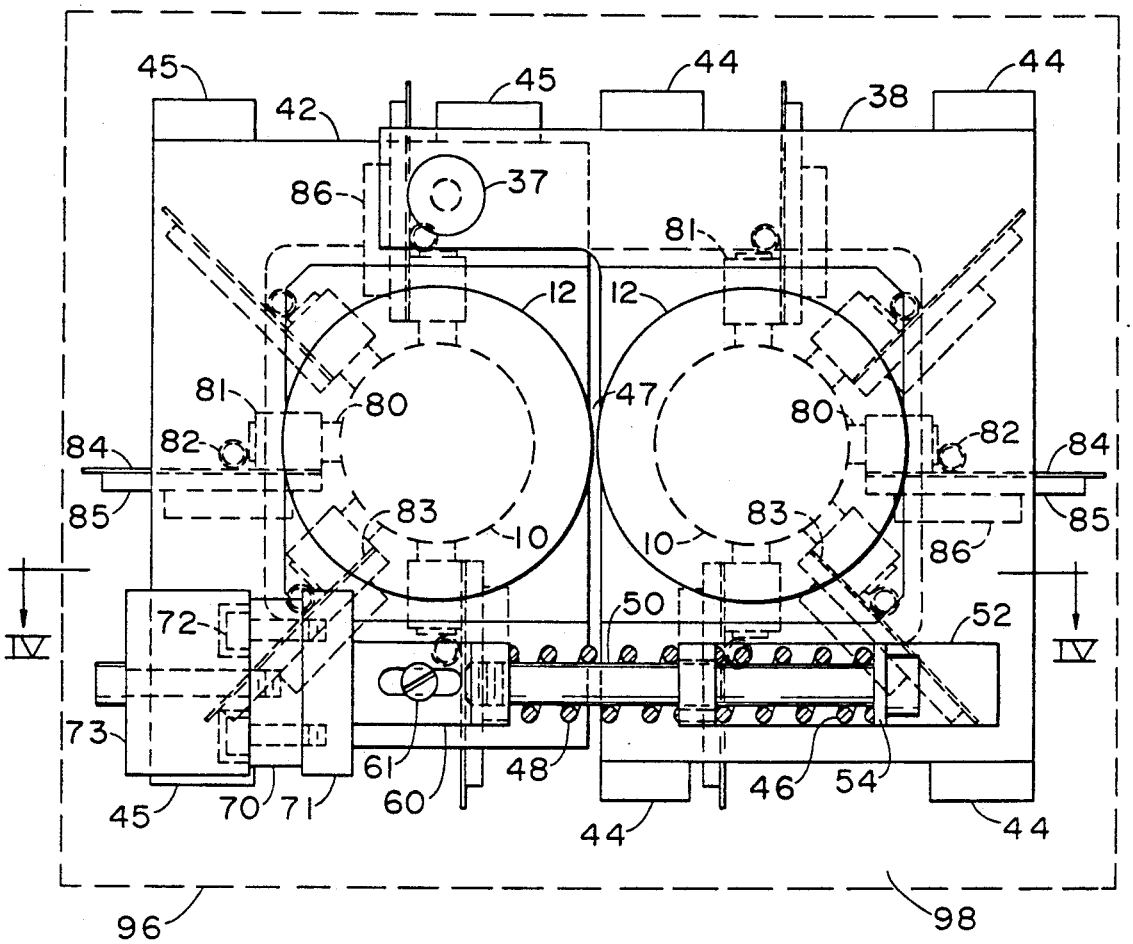
Figure 3:
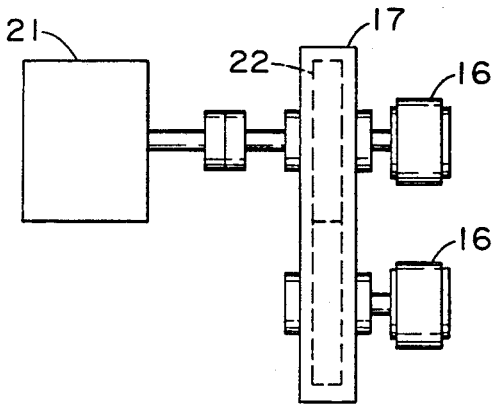
Figure 4:
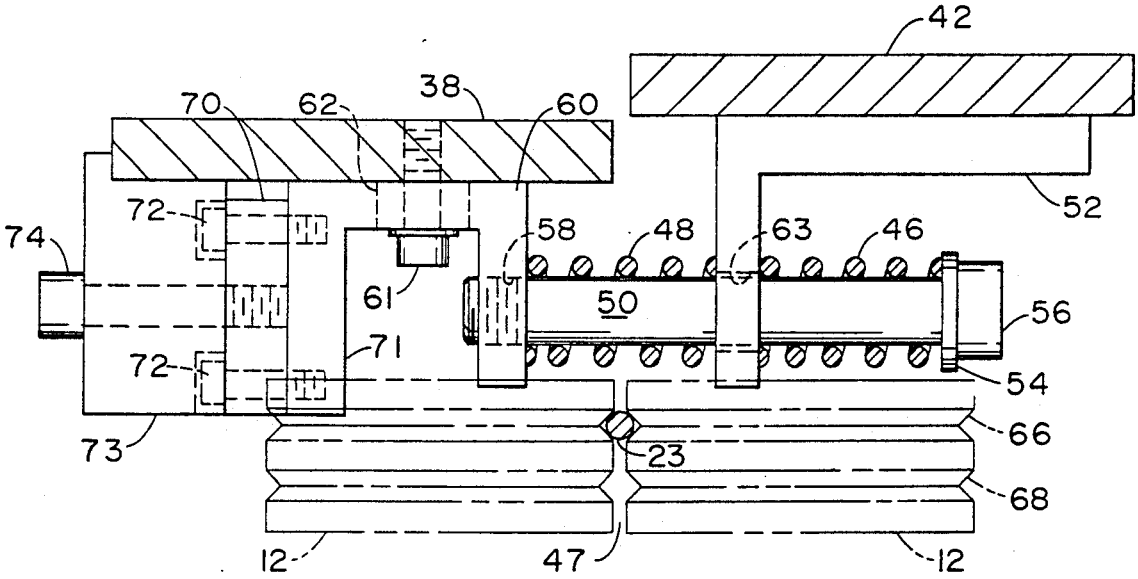

The invention, along with its advantages and objectives, will be best understood from consideration of the following detail description and the accompanying drawings in which:

FIG. 1 is, inter alia, a side elevation view of the system and assembly of the invention, the view showing only one rotatable shaft in longitudinal section supporting one commutating wheel, with five upper and five lower stationary brushes engaging the shaft along its length dimension;

FIG. 2 is a front elevation view of the assembly of FIG. 1 showing, inter alia, two opposed commutating wheels for physically contacting a rod or bar, with five stationary brushes shown engaging each of the shafts that rotatably support respectively, the opposed wheels; the upper and lower brushes visible in FIG. 1 are the uppermost and lowermost brushes shown in FIG. 2. Hence, each shaft has 25 brushes engaging it. In viewing an end or cross section of each shaft, five brushes are visible, and are located about half way around the periphery of each shaft;

FIG. 3 is a plan view of two gear boxes employable in the system of the invention taken along lines III—III of FIG. 1; and FIG. 4 is a plan view of a wheel adjusting feature of the invention taken along lines IV—IV of FIG. 2.

PREFERRED EMBODIMENTS

Referring now to the drawings, FIG. 1 thereof shows one of two hollow relatively large diameter shafts 10 supporting wheels 12 at the right hand ends thereof. End elevation and plan views of the wheels are shown respectively in FIGS. 2 and 4; the ends of the shaft are shown in dash outline in FIG. 2.

Both ends of each shaft 10 are mounted in suitable bearings 14 (FIG. 1) for rotation, and both of the shafts and wheels are preferably driven (rotated) by timing belts 16 (only one of which is visible in FIG. 1) extending between a gear box 17 and a pulley 18 of a slip clutch 19 provided for each shaft. As shown further in FIGS. 1 and 3, the drive arrangement includes a motor 20 which is mechanically connected to means 21 for reducing the speed at which gear box 17 is driven. Box 17 contains two gears 22 (FIG. 3), one gear for each shaft 10. The gears mesh together so that they rotate simultaneously and at the same speed but in opposite rotational directions. Shafts 10 and wheels 12 are thus rotated in opposite directions at equal speeds to receive a rod of material 23 between the wheels.

Pulleys 18, when driven by belts 16, drive respective shafts 10 through respective slip clutches 19. The purpose of the clutches is to prevent any relative motion between either wheel 12 and rod 23. This can be accomplished by sprag, overrunning type clutches. Such clutches have an outer race driven by pulley 18 and an inner race keyed to shaft 10 (at 19*a*) upon which wheel 12 is attached. Sprags (not shown) are located between the outer and inner races such that the outer race drives its shaft 10 through the mechanical action of the sprags. A discussion of sprags and sprag clutches is contained in an article entitled "Higher Speeds for Sprag Clutches" published in the Aug. 26, 1982 issue of *Machine Design*, pgs. 111 to 114.

When wheel diameters are equal and are driven at the same rpm there will be no relative motion between the peripheral surfaces of the wheels and the rod. When different wheel diameters are used, however, as may happen when one is machined to recut rod accommodating grooves, the larger wheel becomes the pace setter and the smaller wheel must then rotate faster to "catch up" and match its surface speed to that of the larger wheel and the speed of the rod. This happens through the action of the sprags in clutches 19, i.e., the sprags allow the inner race, and all mechanical connections to it including wheel 12, to slip or overrun the driven outer race to match rod speed. Both wheels are thereby synchronized to each other and with the speed of the rod.

The reverse of the above cannot occur, i.e., for the smaller wheel to be the pace setter and the larger wheel to slow down, since the speed of the smaller wheel is established by the speed at which motor 20 is set.

The accuracy of the slip clutches is such that there is zero percent difference between the lineal speed of the rod and the peripheral speed of the wheels. Such control ensures that one wheel will not slip on the rod while the other rotates at the lineal speed of the rod.

The matching of rod and wheel speed prevents arcing since the continuous presentation of wheel surfaces to the traveling rod surface at the same speed appears to be the best way to ensure maximum mechanical and electrical contact between the rod and wheels. In addition, the rate of the supply of rod material 23 to molten metal 24 will be proper and constant. A proper, constant supply of material increases the consistency in the alloying process.

As will be apparent hereinafter, wheels 12 function primarily as means to commutate electrical current to rod 23, as it is being directed to the alloying process at 24. Hence, wheels 12 need not be "drive" wheels, as other means, such as roller or caterpillar tread devices, represented schematically in FIG. 1 by numeral 25, when properly synchronized with wheels 12, can be used to feed rod 23 to and through the wheels to process 24 from a supply of the rod at 26.

As shown in FIG. 1, a rotatable, dual flow union 27 is connected in fluid communication with the interior of each hollow shaft (though only one union is visible in FIG. 1). The union serves to conduct a coolant to and from the shafts. At the ends of the shafts opposite the unions, i.e., at the ends adjacent wheels 12, a first plate 28, with a recess 30, is provided and is bolted to the shaft end. Recess 30 provides a return path, in combination with a second plate 32 bolted over recess 30, to connect a center bore 34 of the shaft to outer bores 36. In this manner, a coolant directed into the input portion of dual union 27 travels through outer bores 36, recess 30 and inner bore 34 to leave the shaft via the output of the union. As shown in FIG. 1, wheel 12 and plate 32 is bolted to the first plate 28.

Such a cooling system is provided to remove heat from the shafts and wheels. The shafts and wheels are constructed to carry substantial amounts of electrical current, the flow of which tends to heat the shafts and wheels to a substantial degree.

The shafts and wheels of the invention are generally identical and are mounted in a manner that allows one shaft and wheel (and stationary brushes described below) to rotate about a pivot position, which includes two bearings 37 (FIG. 1) relative to the other shaft and wheel.

More particularly, the right hand shaft and wheel in FIG. 2 are mounted in fixed front and rear plates or frames 38 (FIG. 1). The right hand shaft is mounted for rotation in plates 38 by bearings similar to bearings 14. As seen in FIG. 1, bearings 14 are mounted in the front and rear plates or frames 42. The shaft and wheel visible in FIG. 1 are thus the left hand shaft and wheel in FIG. 2.

The left hand wheel and shaft (in FIG. 2) are mounted in front and rear frames 42, via front and rear bearings 14, with frames 42 being mounted on fixed plates 38 by pivot bearings 37. Hence, the left hand shaft and wheel are mounted for rotation about pivot bearings 37, and relative to fixed frame 38.

Each set of the front and rear frames 38 and 42 are connected together by horizontal, upper and lower frame members 44 and 45 to generally enclose and house their respective shafts.

Wheels 12 are mounted in their respective frames in a manner that locates the wheels in the same plane so that the peripheries of the wheels will engage a wire, rod or bar 23 on opposed surfaces thereof, as seen in FIGS. 2 and 4.

A purpose of the pivotal mounting the frames of 38 and 42 is to allow adjustment of one wheel 12 relative to and in the plane of the other to accommodate between them rods 23 of different sizes (diameters). Pivotal mounting also allows the wheels to accommodate the build-up of material on the surfaces of the rolls that engage the rod. Control of a rod accommodating space 47 between the wheels is effected by an adjustment mechanism that includes two open coil springs 46 and 48. These are visible in the front view of FIG. 2 and in the plan view of FIG. 4, with an identical set (not visible) being located at the rear of the overall assembly. The springs are mounted in axial alignment on an elongated bolt or shaft 50 that extends between the two frames 38 and 42. More particularly, spring 46 is compressed between a bracket 52 of fixed frame 38 (FIG. 4) and a washer 54. The washer is located on and adjacent the right hand end of bolt 50. It is secured on the bolt by head 56 of the bolt. The left hand end of bolt 50 is secured to the left hand frame 42 by being threaded into a threaded opening 58 provided in a U-shaped bracket 60, as shown in FIG. 4. Bracket 60 is slidably mounted on and fastened to frame 42 by a bolt 61 extending through an elongated slot 62 provided in the bracket. Bolt 50 extends through an opening 63 provided in fixed bracket 52.

A pulling action of spring 46 on bracket 60 and frame 42 compresses spring 48, which is secured between brackets 52 and 60, on shaft 50. When the turns of spring 48 are closed by the force of spring 46, which is the stronger of the two springs, the peripheries of the two wheels are separated by a minimum space. This allows threading of rod 23 between wheels 12, which are shown in FIGS. 1 and 4 as having two side-by-side peripheral grooves 66 and 68. The force of spring 46 is sufficient to deform and flatten somewhat rod 23 being continually received in one of the grooves so that the area of the rod in contact with the surfaces of the groove is maximum. With maximum contacting surface, maximum current is conducted from the rollers to the rod, and arcing and pitting of the wheels is prevented.

The peripheral grooves 66 and 68 provided in wheels 12 are depicted in FIGS. 1 and 4 as being V-shaped. The grooves can have other suitable shapes to receive rod 23 and to provide the necessary transfer of electrical current from the wheels to the rod with little or no arcing.

Because of arcing and pitting problems that can occur between a rod of material and commutating wheels when contact is made between the free end of the rod and molten metal 69, of alloying process 24, as explained earlier, the mechanical loading of the wheels against the rod is extremely important. It is preferable, therefore, that this load be monitored, as too little compression may result in reduced current transfer to the rod, and possible attendant arcing, while over compression of the rod may overload drive motor 18. Further, a flattened rod may have difficulty in entering structures (not shown) for guiding the rod from the wheels to the molten metal of process 24.

A load cell 70 is shown in FIGS. 2 and 4 located on rotatable frame 42 to be acted upon by shaft 50 and spring 46. The load cell is attached to a left arm 71 of movable bracket 60 by bolts 72, and located between arm 71 and a plate 73 associated with frame 42. The load cell is connected to plate 73, which is fixed relative to bracket 60 and arm 71, by a bolt 74. Plate 73, if made of a separate piece of material, is suitably attached to a left hand portion of 42.

With the pull of spring 46 on bracket 60, the bracket moves relative to bolt 61 to place load cell 70 in tension. As a result, the cell outputs a voltage, the level of which is a direct measurement of the amount of force (tension) exerted by the net force of springs 46 and 48 on the cell, and thus the amount of compressive load of wheels 12 on rod 23. If the load is found to be too high or too low, bolt head 56 can be manually rotated to rotate bolt 50 in bracket 60 to adjust the compression on spring 46.

As seen in the view of FIGS. 1 and 4, rod or bar 23 is accommodated between the wheels and in one of the grooves 66 or 68 provided in the periphery of each wheel. Two grooves are provided for the purpose of having available a second, fresh groove and groove surface should the first groove become worn or coated with foreign matter to the extent that current flow would be unduly impeded between the wheels and rod. In using the second groove, the wheels can be removed from and reversed on the ends of their respective shafts 10, or the path of travel of rod 23 moved to align it with the unused groove.

Extending along and about each shaft 10 are five rows of stationary brushes 80. The brushes are mounted in brush holders 81, each of which has an arm 85 extending rearwardly from the holder. The brushes engage the shafts under the pressure exerted by coils 82 (depicted schematically in FIG. 2 and shown pressing against the rear of the brushes) of respective flat springs 83. The springs are preferably constant force springs so that the force at which the brushes engage the shafts remain constant over time, i.e., as the brushes wear they are moved toward the shafts by the coils of the springs. Each spring 83 is suitably attached to a sheet of rigid metal 84 secured to the arm 85 of each brush holder. Arms 85, in turn, are attached to respective rigid sub buses 86, which buses maintain the elongated extent of the spring flat so that its coil 82 presses consistently against brush 80.

Brushes 80 supply electrical current from preferably a direct current (DC) source of voltage 88. A positive pole of the source is shown connected, via a lead 89 in FIG. 1, to a main bus 87, the main bus electrically connecting the sub-buses 86 together.

Main bus 87 supplies all of the brushes associated with one of the shafts with electrical current. A second separate bus (not shown) supplies the other one of the shafts, and is connected to power supply 88 by a second lead 90. This ensures even distribution of current between the two shafts.

To ensure that electrical current is directed through sub-buses 86, which are preferably copper, rather than through the frame of the apparatus (38, 42, 44, and 45) which is preferably steel, and through bearings 14, to the brushes and shafts, an insulating washer 91 (FIG. 1) is employed to isolate sub-buses 86 from the frame. The washer is located on a bolt 92 that secures each sub-bus to its respective frame 38 and 42, at both front and rear locations of the frames, though only one washer and bolt is depicted in FIG. 1. The length of each sub-bus is sized to clear the inwardly facing surfaces of frames so the sub-buses do not physically and electrically contact the frame. The bolts 92, which secure each end of each sub-bus to its associated frame, ensures this, while the washers 91 insulate the heads and shanks of the bolts from the copper buses.

Each sub-bus 86 commonly connects five brushes together in a row, i.e., there is a sub-bus 86 for each row of five brushes. In FIG. 1, only two buses and two rows of brushes are shown. In FIG. 2, the initial brush of each row is shown in dash outline. There are thus five rows of five brushes contacting each shaft 10, and thus ten sub-buses. Each brush 80 is electrically connected to its associated sub-bus by a relatively short length of copper cable not visible in the drawings.

The negative pole of power supply 88 is connected to the body of molten metal 69 via a lead 93 and an inverted U-shaped contact member 94. Electrical current is thus conducted from the power supply to and through sub-buses 86 to brushes 80, then to shafts 10 and hence to commutator wheels 12. From the wheels, current is commutated to rod 23, and then from the free end of the rod through an arc (not shown) to molten metal 69.

Power supply 88 is preferably one that provides a constant level of voltage, to ensure a consistent supply of energy to the alloying process of 24, and one that limits the magnitude of current transients to prevent arcing between rod 23 and wheels 12.

In changing the constituency of a body or flow of molten metal with a rod of alloying material, such as disclosed in the above Eckert et al patents, a substantial amount of current is needed to superheat and spray the metal of the rod, i.e., the current can be as much as 7500 amperes. This requires conduction of the current preferably at a low voltage (i.e., on the order of ten to thirty volts) from power supply 88 to shafts 10 with a minimum of electrical resistance and at high current densities (i.e., 400,000 to $3.3\times10^6$ amperes per square inch). Hence, the need of a large number of sizable, stationary brushes. Such an arrangement, however, does not preclude the use of lower amounts of current and higher voltages, as the brushes are equally effective in conducting such lower currents. The actual diameters of shafts 10 and the size of brushes 80 are dependent upon such parameters as the amount of current to be conducted to wheels 12 and the materials of the shafts and brushes. In using a beryllium-copper alloy for the shafts and high capacity copper alloy brushes that provide the above cited high current densities, a shaft diameter of four inches was found suitable.

Similarly, the large shafts and wheels (10 and 12) are equally effective in transferring large or small amounts of current to a rod or bar 23 traveling at substantial velocity. In the above referenced alloying process, for example, ten to 1000 pounds of rod material per hour is needed to properly feed a trough of molten aluminum feeding the aluminum to a casting process.

The materials of the shafts 10 and wheels 12 must be both good conductors of electrical current while simultaneously being resistant to the wear of brushes 80 and rod material 23. A material that has been found suitable in this regard, for both the shafts and wheels, is a beryllium-copper alloy having a conductivity of 45% IACS. Preferably, each wheel is provided with a rim or coating 95 of tungsten, which is more resistant to arcing than the beryllium-copper of the main bodies of the wheels. If a rim or tire of tungsten is used, grooves 66 and 68 are provided in the rim, the rim then being shrunk fitted on the body of each wheel. If a tungsten coating is employed, the grooves are first provided in the periphery of the wheels, and the periphery and grooves then coated with tungsten.

The material of wheels 12, and the compression of the traveling rod 23 between the wheels provided by spring 46, are such that the quality of the rod surface need not be high to effect a maximum transfer of current from the wheels to the rod. The rod and bar employed in the present invention can have rough, scalely surfaces and be coated with lubricants and/or oxides yet still receive substantial amounts of current from the wheels.

As shown in dash outline in the drawings, shafts 10, rollers 12 and brushes 80 are enclosed in a housing 96. The housing provides a chamber 98 that is sealed against the atmosphere outside of the housing, and is maintained at a pressure positive with respect to the outside atmosphere. In this manner, no contaminants can enter the chamber to collect on the components therein. An inert gas, such as argon, can be directed into the chamber under pressure to maintain the positive pressure.

While the invention has been described in terms of preferred embodiments, the claims appended hereto are intended to encompass all embodiments which fall within the spirit of the invention.

What is claimed is:

1. A method of alloying molten metal media by adding alloying material to the media in the form of a rod of the material, comprising:

providing a supply of rod material, providing opposed wheels associated respectively with two adjacent parallel shafts, directing said rod of material through said wheels and towards a molten media, forcing said wheels against said rod of material, as it is directed toward said molten media, and supplying current to said wheels and rod through a plurality of stationary brushes engaging said shafts over an extended surface thereof in amounts sufficient to melt a free end of said rod in an electrical arc developed between said free end and the molten media.

2. The method of claim 1 including supplying current to said brushes through independent buses provided for respective shafts and wheels.

3. The method of claim 1 in which the rod is directed to the molten metal at rates on the order of five to one thousand pounds of rod material per hour.

4. The method of claim 1 including supplying current to the rod in the range of 100 to 7500 amperes at an electrical potential in the range of ten to thirty volts.

5. The method of claim 1 in which the density of the current at the rod/wheel interface is on the order of 400,000 to 3,300,000 amperes per square inch.

6. The method of claim 1 including forcing the wheels against the rod at a pressure sufficient to partially flatten the rod.

7. The method of claim 1 including maintaining an inert atmosphere about the wheels, shafts and brushes.

8. A method of feeding a rod of at least one alloying element to a body of molten metal for adjusting the composition thereof wherein substantial amounts of electrical current is supplied to said rod, the method comprising:

providing a supply of rod material, directing said rod toward a body of molten metal through a pair of opposed wheels associated respectively with two adjacent parallel shafts at rates on the order of five to one thousand pounds of rod material per hour, forcing said wheels against said rod as it is directed toward said molten metal, and supplying current to said wheels and rod through a plurality of stationary brushes engaging said shafts over an extended surface area thereof, said current being supplied in amounts sufficient to melt a free end of said rod in an electrical arc developed between said free end and the molten metal.

* * * * *